United States Patent [19]

Lisec

[11] Patent Number: 4,921,022

[45] Date of Patent: May 1, 1990

[54] APPARATUS FOR FILLING INSULATING GLASS WITH A SPECIAL GAS

[76] Inventor: Peter Lisec, Bahnhofstrasse 34, A-3363 Amstetten-Hausmening, Austria

[21] Appl. No.: 282,255

[22] Filed: Dec. 9, 1988

[30] Foreign Application Priority Data

Jan. 11, 1988 [AT] Austria ..... A43/88

[51] Int. Cl.[5] ..... E06B 3/66

[52] U.S. Cl. ..... 141/129; 141/65; 141/59; 141/100; 141/181; 141/231; 53/476; 53/403; 53/79; 156/99

[58] Field of Search ..... 141/4, 5, 7, 9, 59, 141/65, 100, 103, 104, 129, 181, 183, 184, 231, 232, 233; 156/99, 106, 107; 29/455.1; 53/403, 404, 405, 79, 476

[56] References Cited

U.S. PATENT DOCUMENTS

| | | | |
|---|---|---|---|
| 2,875,792 | 3/1959 | Moyer | 141/4 |
| 2,875,794 | 3/1959 | Schmertz | 141/4 X |
| 3,078,627 | 2/1963 | Danipace et al. | 53/403 |
| 3,842,567 | 10/1974 | Zwart et al. | 53/403 |
| 3,914,000 | 10/1975 | Beckerman et al. | 53/403 X |
| 4,299,639 | 11/1981 | Bayer | 156/99 X |
| 4,369,084 | 1/1983 | Lisec | 156/107 X |
| 4,559,001 | 12/1985 | Wiedenhofer et al. | 156/107 X |
| 4,708,762 | 11/1987 | Lenardt | 156/107 X |

FOREIGN PATENT DOCUMENTS

| | | | |
|---|---|---|---|
| 613105 | 1/1961 | Canada | 29/455.1 |
| 0046847 | 3/1982 | European Pat. Off. . | |
| 8025477 | 1/1981 | Fed. Rep. of Germany . | |
| 8025478 | 1/1981 | Fed. Rep. of Germany . | |
| 3025122 | 1/1982 | Fed. Rep. of Germany . | |
| 3117256 | 11/1982 | Fed. Rep. of Germany . | |
| 3402323 | 8/1985 | Fed. Rep. of Germany . | |
| 1345238 | 1/1974 | United Kingdom | 29/455.1 |

*Primary Examiner*—Ernest G. Cusick
*Attorney, Agent, or Firm*—Young & Thompson

[57] ABSTRACT

For filling insulating glass with a special gas, a probe (17) that can be introduced through an opening (25) in the spacer (26) for filling with the special gas, and a device (19) for sealing the opening(s) (25, 27) in the spacer (26) after completion of the filling process are arranged on a joint component (16) on the outlet side of a platen press (1, 2) for applying pressure to the glass plates of the insulating glass. The component (16) can be displaced from a readiness position wherein it is arranged below the conveying route (3, 13) for the insulating glass into a first operative position wherein the probe (17) is associated with the filling openings (25) in the spacer (26) and into a second operative position wherein the device for sealing the openings, which device preferably comprises filling nozzles (19) for feeding sealing compound (28) into the openings to be sealed, is associated with the openings (25, 27) in the spacer (26).

9 Claims, 4 Drawing Sheets

APPARATUS FOR FILLING INSULATING GLASS WITH A SPECIAL GAS

FIELD OF THE INVENTION

The invention relates to an apparatus for filling insulating glass with a special gas, with a probe that can be introduced through an opening in the spacer for purposes of filling with the special gas, and with a device for sealing the opening(s) in the spacer after the filling step has been completed, wherein the probe and the device are arranged on the outlet side of a facility for applying pressure to the glass plates of the insulating glass, especially a platen press.

THE PRIOR ART

Various methods and devices have been suggested for filling insulating glass with a filler gas (special gas, e.g. $SF_6$). In this connection, attention is invited to EP-Al-46 847, German Patent 3,025,122, DOS 3,402,323, DOS 3,117,256, as well as the two German Utility Models 80 25 477 and 80 25 478.

The conventional devices present the problem that a long period of time passes until the filling step is completed so that the cycle times customary for insulating glass manufacture (about 20 seconds) can no longer be maintained. The reason for this is that filling of insulating glass with filler gas must take place slowly to avoid buildup of high pressure within the insulating glass which would lead to detachment of the glass plates from the spacer. Thus, EP-Al-46 847 proposes to perform filling with filler gas (special gas) so that the pressure in the interior of the insulating glass remains constant. This reference does not contain any information on when the filling procedure is to be terminated.

Frequently, the filling step during the filling of insulating glass units with a filler gas is continued until the oxygen content of the exhausted gas, in the zone of the exhausting point, falls below a predetermined value. Therefore, an oxygen sensor must be arranged in the exhaust conduit, resulting in an additional cost for the facilities.

OBJECT OF THE INVENTION

The invention is based on the object of providing an apparatus of the type discussed above which makes it possible to perform filling with filler gas quickly and simply and to quickly reseal the openings in the spacer necessary for the filling process.

BRIEF SUMMARY OF THE INVENTION

According to the invention, this object has been attained by providing the probe as well as the device for sealing the openings on a component common to both of them, this component being movable from a readiness position wherein it is located below the conveying route for the insulating glass into a first operative position wherein the probe is associated with the filling opening in the spacer, and being movable into a second operative position wherein the device for sealing the openings is associated with the openings in the spacer; and that the probe is mounted on the component to be slidable forwards and backwards in the conveying plane of the insulating glass.

Based on the provision suggested according to this invention, the filler gas can be injected into the insulating glass under a high pressure and thus with a correspondingly high velocity; filling speeds of 60-200 l/min are feasible. Due to the fact that the glass plates are pressed against the spacer frame by externally applied pressure, there is no danger that the glass plates can be detached from the spacer frame. Also, an outward migration of the spacer frames, located between the two glass panes of the insulating glass, under the pressure of the filler gas is prevented. As soon as the filling step is completed, the component carrying the probe and the device for sealing the openings is placed in its second operative position (e.g. lowered), and the openings are sealed without having to move the insulating glass in the interim.

The mode of operation according to this invention and the apparatus of this invention also permit the only partial filling of the insulating glass unit with filler gas (for example heavy gas $SF_6$), desired for soundproofing purposes. This could not be accomplished heretofore with the use of an ordinary oxygen sensor in the exhaust conduit. In case of the invention, it is simply enough to inject the given quantity of filler gas, based on the volume of the inner space of the insulating glass (i.e. the desired fraction of internal space volume).

BRIEF DESCRIPTION OF THE DRAWINGS

Additional details and features of the invention can be derived from the description set forth below wherein reference is had to the schematic drawings wherein one embodiment of the invention is illustrated. In the drawings.

DETAILED DESCRIPTION OF THE INVENTION

Figure 1:
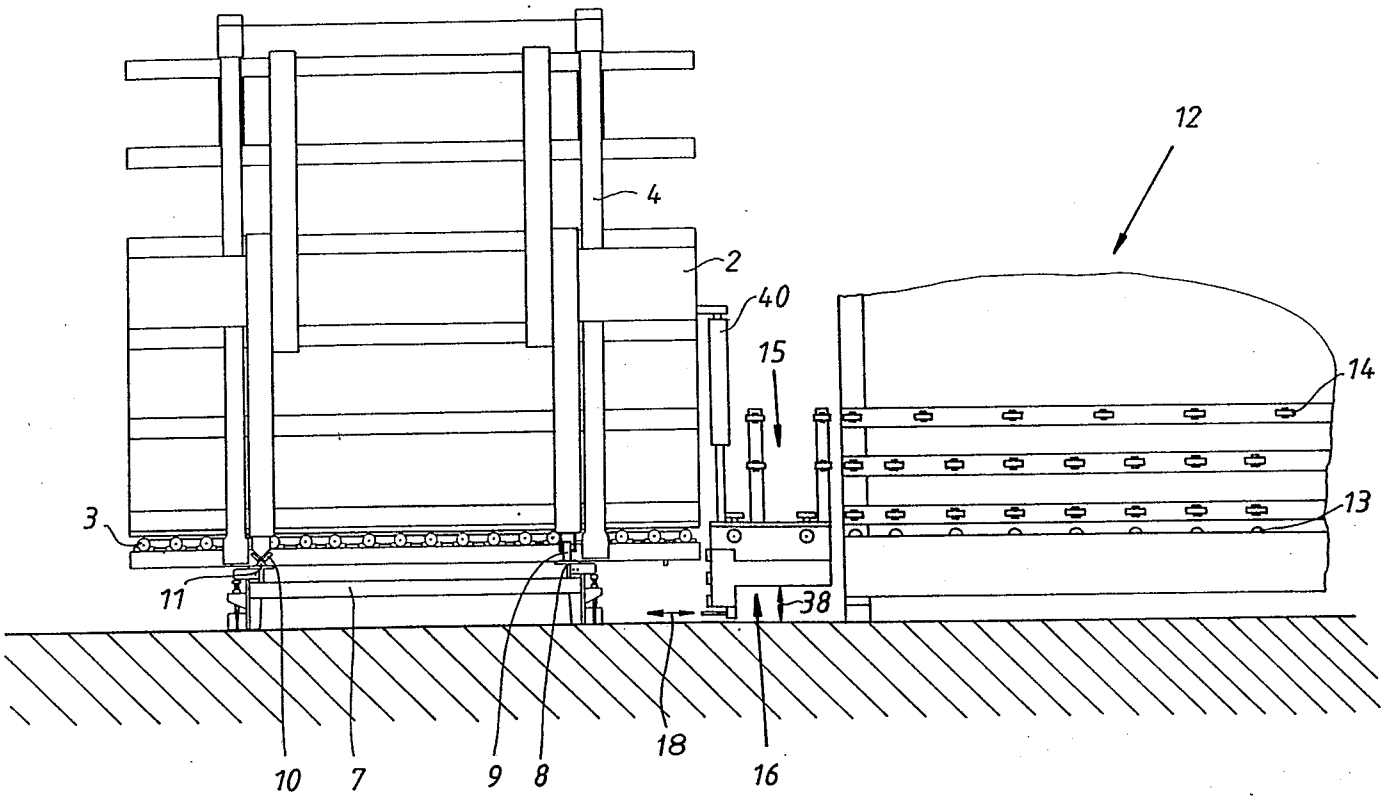
FIG. 1 shows an apparatus for filling insulating glass with filler gas.
Figure 2:
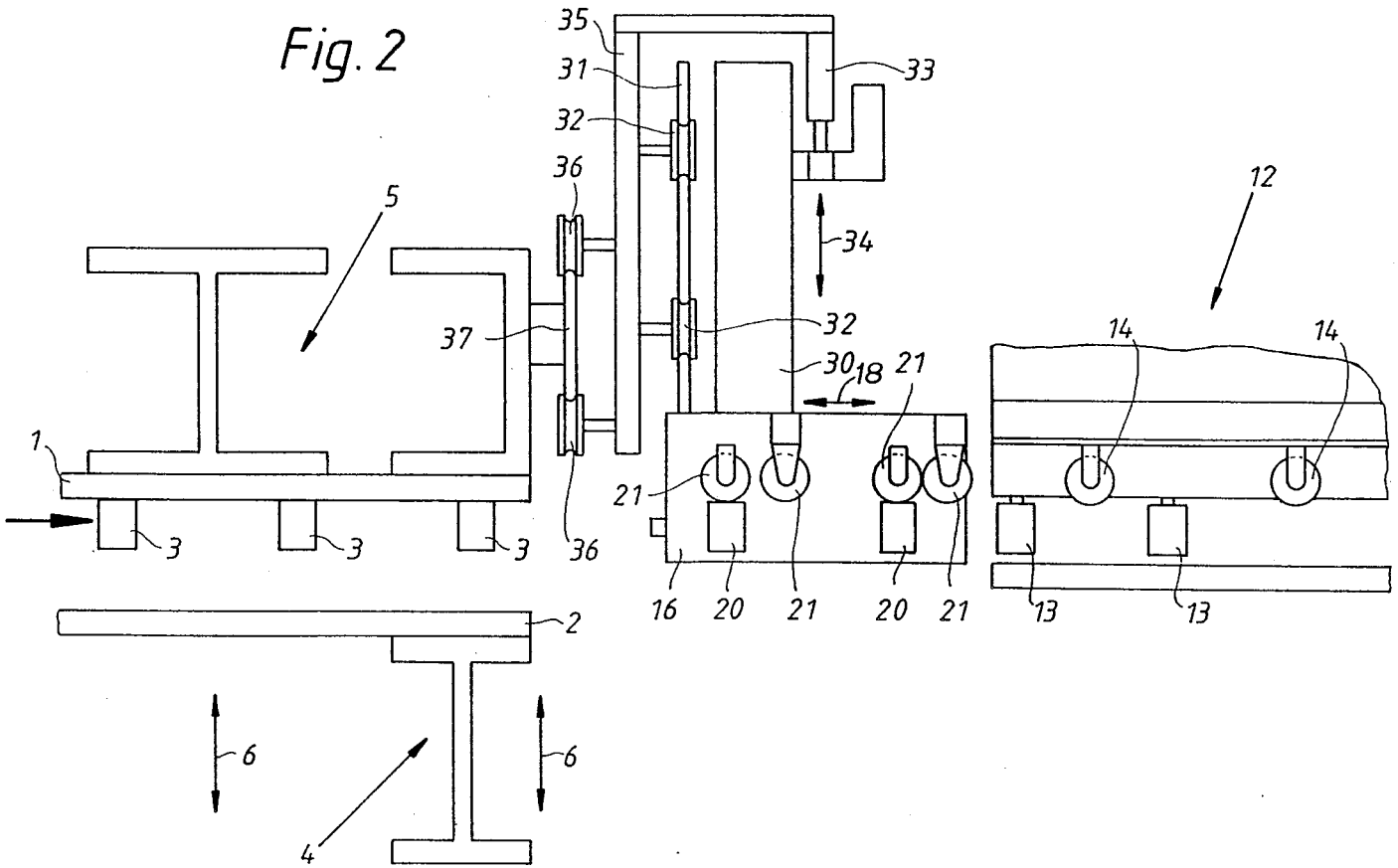
FIG. 2 shows the apparatus of FIG. 1 in a top view.

An apparatus illustrated in FIG. 1 for filling insulating glass with a filler gas comprises two plates 1 and 2 that can be moved toward each other. These plates 1 and 2 are, for example, the pressure platens of a platen press for compressing insulating glass, as known from German Patent 3,130,645. A position conveyor 3, constituted by several rollers, for example, is arranged below the bottom edge of plates 1 and 2. The positioning conveyor 3 serves as the transport means for feeding insulating glass into the interspace between the two pressure platens 1 and 2.

Another embodiment of a pressing device usable in the filling apparatus of this invention comprises a machine frame wherein the two pressure plates 1 and 2 are disposed. One pressure plate 2 is attached to a frame 4 that can be reciprocated in the direction of double arrow 6 on the machine base 7 whereas the other pressure plate 1 is mounted on a frame 5 stationary on the machine base 7. At the lower edge of the pressure plates 1 and 2, a positioning roller track 3 is provided for the feeding of the insulating glass elements to be compressed and to be filled with filler gas.

On the frame 4 of the movable pressure plate 2, threaded spindles are arranged in the four corners of the frame, engaging into clearance-free nuts of ball-circulating guideways, these nuts being rotatably arranged in the frame 5. Each of the nuts of the ball-circulating guideways is connected with a gear wheel and an endless gear belt is placed over the gear wheels. For driving the gear belt, a drive motor is provided, the pinion of which is looped around by the toothed belt by more than 90°. In order to ensure the looping of the gear belt around the drive pinion in this way, a guide roller is provided in an auxiliary frame which latter also carries the drive motor. The guide roller is mounted on a bearing block which can be adjusted with the aid of adjusting nuts with respect to an abutment. By the adjustment of the guide roller, the tension of the endless gear belt can simultaneously be set to the respectively desired value.

The frame 4 of the apparatus of this invention, carrying the movable pressure plate 2, is supported at its lower end on the machine base 7 by way of rollers. As can be seen from FIG. 1, a roller 9 is arranged in the region of one of the lower corners, this roller traveling on a flat rail 8 mounted on the machine frame 7.

In the region of the other lower corner, two rollers 10, mutually inclined by 90°, are provided, these rollers traveling on an angled guide rail 11 attached to the machine base 7. In this way, in spite of ready mobility, an exact guidance of the frame 4 is ensured.

The drive motor is preferably a servomotor coupled with a unit for detecting the revolutions executed by the motor so that, based on the number of revolutions of the drive motor, the mutual spacing of the two plates 1 and 2 can be detected. This can be exploited for arresting the drive motor after the latter has executed, starting with a predetermined initial position, the required revolutions for compressing the insulating glass to the desired thickness.

In order to prevent the compacting pressure exerted by the two pressure plates 1 and 2, under the drive action of the servometer, on the insulating glass element to be compressed from becoming too high, it is furthermore possible to detect the power consumption of the motor and to restrict power consumption to a value corresponding to the desired compression force.

In this way, using the simplest means, it is ensured that insulating glass is pressed exactly to the predetermined magnitude, and that there will be no excessive compression force increasing danger of breakage, while the pressing step is performed.

A device 15 for filling insulating glass with a special gas and for sealing the openings provided for this purpose in the spacer of the insulating glass is located between the platen press and a conveying device 12, arranged downstream of the press, with conveying rollers 13 and a lateral support for insulating glass constituted by freely rotatable backup rollers 14.

The device 15 comprises a component 1, a probe 17 being arranged at the bottom of the latter. The probe 17 is mounted to be slidable forwards and backwards on the component 16 in the direction of double arrow 18 with the aid of a drive mechanism, for example a pressure medium cylinder, so that the probe can be introduced into the interior of the insulating glass through one of the openings located in the spacer of a insulating glass.

The component 16 furthermore carries nozzles 19 by means of which the plastic compound, for example a material utilized for the sealing of insulating glass, can be forced into the openings in the spacer in order to seal the same once the filling step is finished.

Figure 3:
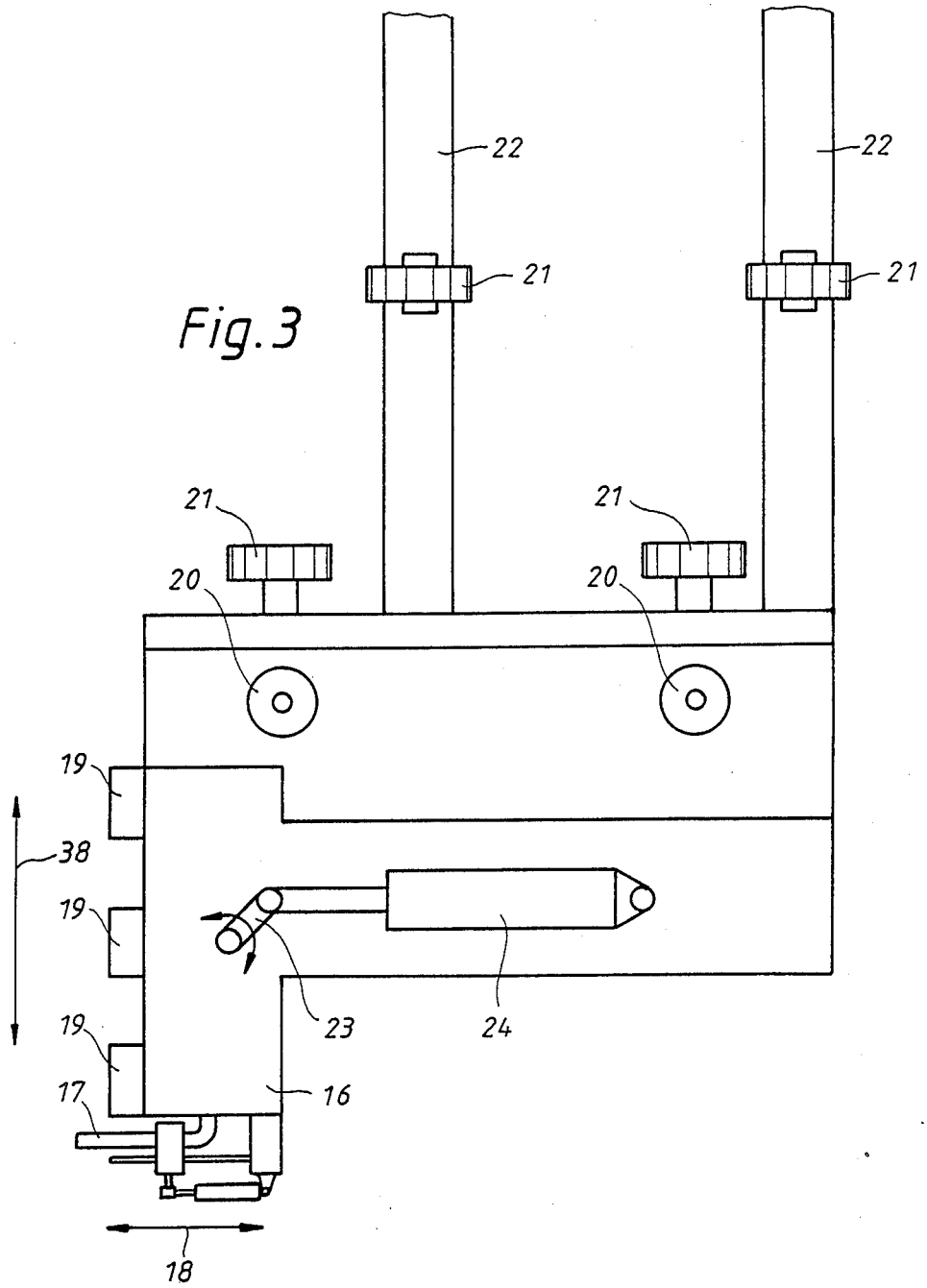
FIG. 3 shows a detail of the apparatus of this invention in a plan view.

The component 16 furthermore carries conveying rollers 20 which are driven and are arranged, in the readiness position of device 15 illustrated in FIG. 1, at the same level as the conveying rollers of the positioning roller track 3 and the conveying rollers 13 of the conveyor 12. Furthermore, guide rollers 21 are provided on the component 16, these rollers being aligned, on the one hand, with respect to the fixed pressure plate 1 and, on the other hand, with respect to the supporting rollers 14 of the conveyor 12, so that a troublefree transport of the insulating glass out of the platen press to the conveyor 12 is possible. As illustrated in FIGS. 1 and 3, some of the freely rotatable backup rollers 21 of the device 15 are mounted on supports 22 oriented upwardly from the component 16.

Conduits, not shown, lead to the unit 15 for the feeding of gas with which the insulating glass is to be filled, and for the sealing compound, the feeding of which to the nozzles 19 is controlled by a valve operated via a lever 23 and a pressure medium motor 24.

Figure 4:
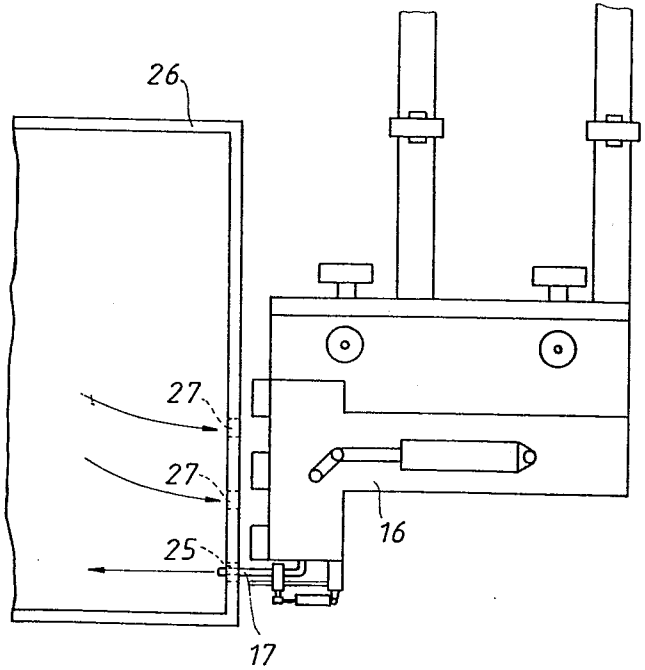
FIG. 4 shows schematically a part of the apparatus during the filling step.

For the execution of the filling step, the component 16 can be raised from the readiness position illustrated in FIG. 1 into the first operative position shown in FIG. 4. In the first operative position, the probe 17 is aligned with respect to an opening 25 in the spacer 26 so that the probe 17 can be introduced through this opening 25 into the interior of the insulating glass. The air displaced from the interior of the insulating glass during the filling step exits by way of at least one further opening 27 in the spacer 26.

Figure 5:
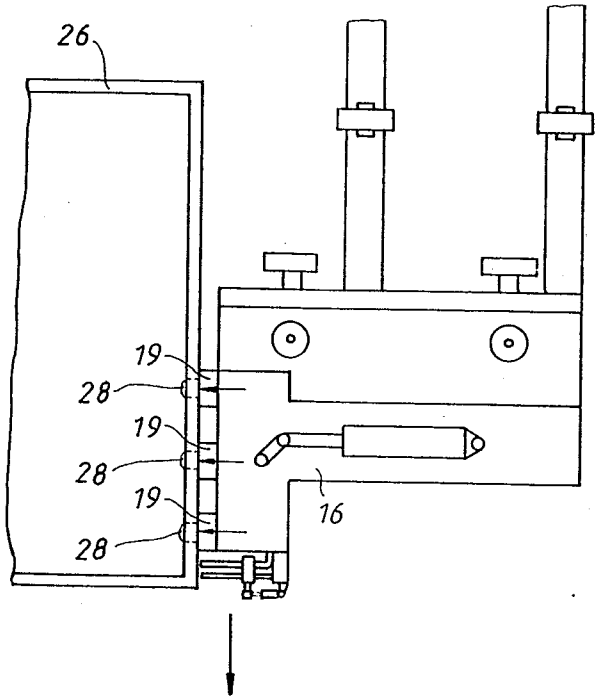
FIG. 5 shows schematically a part of the apparatus during the sealing of the openings in the spacer.

Once the filling step is completed, the probe 17 is retracted from the opening 25 in the spacer 26, and the component 16 is lowered into the second operative position shown in FIG. 5 wherein the three nozzles 19 lie in opposition to the openings 25 and 27. At this point, the component 16 is advanced toward the spacer frame until the forward ends of the nozzles 19 come into contact with the spacer, these ends entering the edge joint of the insulating glass. For this purpose, the component 16 can be pushed forwards and backwards in the conveying plane by way of grooved rollers on a guide rail extending in the conveying direction. The guide rail (not illustrated in the drawings) is attached to a slide which latter, in turn, is displaceable upwards and downwards and transversely to the conveying plane, as will be explained below.

After sealing the openings 25 and 27 in the spacer 26, the component 16 is shifted downwards into its readiness position, the nozzles sliding along the spacer 26 in order to prevent the introduced sealing compound 28 from being pulled out again from the openings 25 and 27.

The component 16 is mounted on a slide 30 which latter comprises a guide rail 31 extending perpendicularly to the conveying plane of the insulating glass. Rollers 32 of two roller pairs contact the guide rail 31 from both sids so that the slide 30 can be adjusted under the action of a servometer 33 in the direction of double arrow 34 to be able to align the probe 27 and the nozzles 19 exactly in the center between the panes of insulating glass.

The servometer 33 is supported on an auxiliary frame 35, two pairs of rollers 36 being rotatably disposed on this frame. Each roller pair 36 is in contact from both sides with a guide rail 37 attached to the frame 5 of the pressure plate 1 (this being the immobile pressure plate) so that the auxiliary frame 35 and thus the slide 30 and, as a consequence, the component 16, can be shifted in the direction of double arrow 38 from its readiness position into its two operative positions and back again into the readiness position.

In order to move the component 16 in the direction of double arrow 38 (FIGS. 1 and 3), a pressure medium motor 40 engaging the auxiliary frame 35 is provided, this motor engaging, on the one hand, the auxiliary frame 35 and, on the other hand, the frame 5 of the pressure plate 1. The pressure medium motor 40 is controlled by means of switches, not shown in detail, which correspond to the various positions of component 16.

In place of the pressure medium motor 40, another servometer can also be provided.

The adjustment of component 16 in the direction of double arrow 34 takes place by way of the over-all control of the facility in correspondence with the data on the width of the spacer of the insulating glass, fed into the control unit.

I claim:

1. Apparatus for inserting a gas between two sheets of glass that are spaced apart by a spacer, wherein a first opening is provided in the spacer for reception of said gas and at least one second opening is provided through the spacer for the exit of air from between said sheets of glass, comprising means for exerting pressure on the glass sheets during said insertion, means for conveying said sheets, along a conveying route, through and beyond said pressure means, a device including a probe mounted on the device for inserting said gas into said first opening, means mounted on the device for sealing said first opening and said at least one second opening after insertion of said gas, means for moving said device between a first position in which said device is disposed below said conveying route to permit movement of said glass sheets along said conveying route and a second position in which said probe is in alignment with said first opening and a third position in which said sealing means are in alignment with all said openings to seal all said openings, and means supporting said probe on said device for movement relative to said device toward and away from the glass sheets in a direction parallel to said conveying route.

2. Apparatus as claimed in claim 1, in which said sealing means comprises a plurality of nozzles for feeding a sealing compound into said first opening and said at least one second opening, said nozzles having the same spacing as all said openings.

3. Apparatus as claimed in claim 2, in which said plurality of nozzles are located on the same side of said device as said pressure exerting means.

4. Apparatus as claimed in claim 3, and means for moving said device toward and away from said spacer respectively before and after said device is in said third position.

5. Apparatus as claimed in claim 1, and further conveying means on the upper side of said device, said further conveying means being in alignment with the conveying means when said device is in said first position.

6. Apparatus as claimed in claim 5, said further conveying means comprising freely rotatable back-up rollers engaging a major surface of one of said glass sheets, at least some of said rollers being mounted on upright arms.

7. Apparatus as claimed in claim 1, and means for moving said device horizontally transversely to said conveying route.

8. Apparatus as claimed in claim 7, in which said means for moving said device horizontally transversely comprises a fixed horizontal guide rail, and guide rollers carried by said device and engaging both sides of said guide rail.

9. Apparatus as claimed in claim 7, and servo-motor means for moving said device horizontally transversely to said conveying route.

* * * * *